United States Patent [19]

Hadden, Sr.

[11] Patent Number: 4,561,282

[45] Date of Patent: Dec. 31, 1985

[54] DIMINISHING ARM TOGGLE LINKAGE

[76] Inventor: Edward L. Hadden, Sr., 110 E. Maplewood Ave., Mechanicsburg, Pa. 17055

[21] Appl. No.: 655,562

[22] Filed: Sep. 28, 1984

[51] Int. Cl.[4] ..... B21D 9/08; B25B 7/12

[52] U.S. Cl. ..... 72/410; 29/751; 30/184; 72/416; 72/451; 74/105; 81/313; 81/373

[58] Field of Search ..... 72/410, 409, 416, 451; 81/313, 352, 369–380, 346, 312; 29/751; 30/184, 182, 242, 363; 7/107, 108; 74/105, 106, 520

[56] References Cited

U.S. PATENT DOCUMENTS

| | | | |
|---|---|---|---|
| 952,079 | 3/1910 | McIntire . | |
| 1,819,135 | 8/1931 | Sudre | 30/182 |
| 2,369,346 | 2/1945 | Gearhart | 81/87 |
| 2,489,895 | 11/1949 | Kash | 81/84 |
| 2,533,817 | 12/1950 | Koskinen | 81/84 |
| 2,610,534 | 9/1952 | Shaff | 81/84 |
| 2,630,035 | 3/1953 | Zazdrzyk | 81/88 |
| 2,772,591 | 12/1956 | Munroe | 81/88 |
| 2,777,345 | 1/1957 | Reider, Jr. | 81/313 X |
| 2,800,042 | 7/1957 | Demler | 72/410 |
| 3,029,670 | 4/1962 | Over et al. | 29/751 X |
| 3,212,317 | 10/1965 | Lynch, Jr. | 72/416 X |
| 3,630,068 | 12/1971 | Floyd, Jr. | 72/410 |
| 3,793,914 | 2/1974 | Helms | 81/378 |

*Primary Examiner*—Francis S. Husar
*Assistant Examiner*—Steven B. Katz
*Attorney, Agent, or Firm*—Charles J. Long

[57] ABSTRACT

A diminishing arm toggle linkage has the work site within the toggle geometry and thereby provides exponential force enhancement. In preferred embodiments the mode of operation shifts on demand from a light-load-pivoting mode to a heavy-load-rolling element mode thereby easing operation and reducing friction and wear so as to provide prolonged durability and continuing dimensional accuracy. When the toggle linkage is embodied in a crimping tool an optional anti-reversing ratchet assembly prevents the tool from opening during use until a crimp is completed.

12 Claims, 14 Drawing Figures

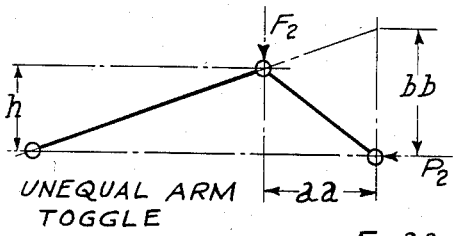
$$P_2 = \frac{F_2 \cdot aa}{bb}$$
Fig. 9
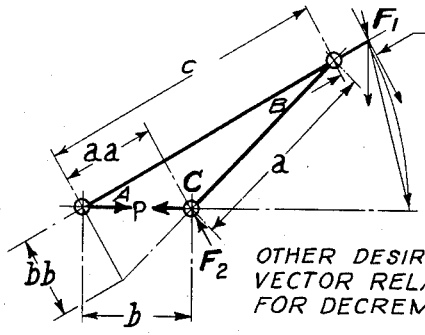
EXTENSION LEVERAGE.
a+b=c=STRAIGHT LINE.
ADD TOOL STROKE TO b MIN= b MAX.
a, b, c ARE KNOWN:
$$\cos A = \frac{b^2 + c^2 - a^2}{2bc}$$
FIND aa, bb, $F_2$, $F_1$ AND OTHER DESIRED GEOMETRICAL AND VECTOR RELATIONSHIPS. REPEAT FOR DECREMENTAL VALUES OF b.
Fig. 10 TOOL LINKAGE BASED UPON UNEQUAL ARM TOGGLE.
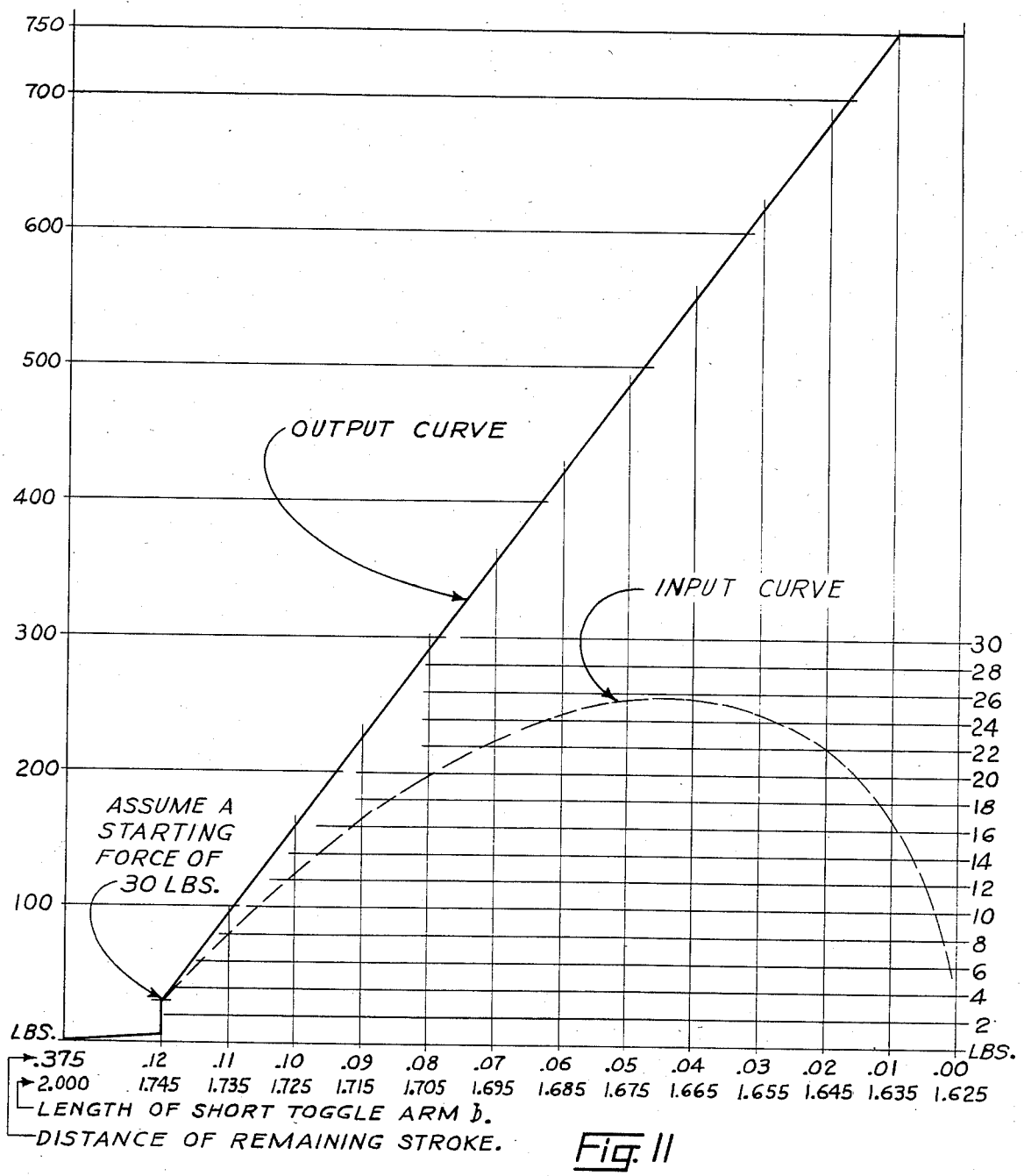
Fig. 11

DIMINISHING ARM TOGGLE LINKAGE

BRIEF SUMMARY OF THE INVENTION

This invention relates to an improved diminishing arm toggle linkage for plier type hand tools and hand or power operated bench presses used for crimping, riveting or staking operations and the like. More particularly, the invention relates to such a linkage in which the force work site is disposed within the geometry of the toggle rather than external to it. In preferred embodiments the invention includes automatic shifting, on demand, from a pivoting mode of operation to a rolling mode as the load at the work site increases.

The prior art includes a variety of simple plier, compound leverage and toggle actuated staking, crimping and riveting tools which have extremely heavily loaded pivot pins subject to friction, wear and galling with attendant dimensional deterioration, all compounded by the number of pivot stages involved. These tools run the gamut from inexpensive, hard to operate tools to expensive easier to operate tools. In all such toggle actuated tools of which I am aware the work or crimping site is external to the toggle arm geometry and the grips are not adapted for one-handed operation.

My invention eliminates many of the aforementioned prior art problems. Staking—crimping tools embodying my invention include (a) an output/input force curve ratio allowing easy, single stroke, one-handed operation in staking a workpiece; (b) a clear, easily entered open-sided work site to accept the workpiece when the tool is wide open; (c) a comfortable, single-handed grip on the wide open handles; (d) provision for removable, interchangeable staking tooling; (e) provision for automatically changing from a pivoting mode of operation to a rolling mode as the load at the work site increases; (f) a staking tool site within the geometrical boundary of the toggle linkage to take greatest advantage of the diminishing arm toggle feature; (g) minimum size and weight consistent with the tool function; (h) a geometrically diminishing rate tool-opening return spring; (i) a late acting tool-kick-open spring which takes effect after the peak input force is passed and does not cause the last portion of the input curve to exceed the already passed peak force; and (j) economical manufacture.

In accordance with the invention, I provide a diminishing arm toggle linkage comprising (a) first and second elongated force applying members having their longitudinal axes aligned, said force applying members each having an inner and an outer end, said inner ends being adjacent to each other on the axial line, said force applying members being mounted for axial movement toward and away from each other between a closed abutting position and an open spaced apart position to thereby define a work space between said inner ends which diminishes axially when said force applying members are moved toward each other; (b) a third elongated member attached for pivotal motion at its one end to a point on said second force applying member spaced from said inner end thereof; (c) a fourth elongated member attached for pivotal motion at its one end to a point near said outer end of said first force applying member; (d) the other end of said third member being attached for pivotal motion to said fourth member at a point spaced from said one end of said fourth member; (e) the distance between attachment points on said third and fourth members respectively defining first and second toggle arms; (f) the distance between the attachment point on said first force applying member and the attachment point on said second force applying member defining a third toggle arm, the length of which varies by the distance from open to closed positions of said first and second force applying members; and (g) the length of said second toggle arm being substantially equal to the length of said first toggle arm plus the length of said third toggle arm in the closed position.

In a preferred embodiment, I provide a tool for forming a work piece to a predetermined shape and size, comprising (a) an elongated chassis member; (b) a first die member fixedly mounted in said chassis member near a first end of said chassis member; (c) a second die member mounted in said chassis member for sliding movement toward and away from said first die member along a common axis which is parallel to the longitudinal axis of said chassis member; (d) said first and second die members having complementary mating surfaces shaped so that when said mating surfaces meet they form a cavity having said predetermined size and shape of said work piece; (e) a first elongated toggle arm member having one end connected for pivotal movement to said first end of said chassis member at a first pivot site; and (f) a second elongated toggle arm member having one end connected for pivotal movement to said second die member at a second pivot site and the other end connected for pivotal movement to said first toggle arm at a third pivot site spaced from said one end of said first toggle arm, wherein the distance between pivot sites on said first toggle arm is substantially equal to the distance between pivot sites on said second toggle arm plus the distance between the pivot site on said chassis and the pivot site on said second die member when said mating surfaces of said die members are tightly abutting, and wherein each pivot site includes a pivot axis which is perpendicular to said longitudinal axis of said chassis member, all said pivot axes being parallel to one another.

Preferably, my tool includes first stop means for limiting to a predetermined length the distance by which said second die member can be moved away from said first die member and second stop means for stopping movement of said second die member towards said first die member at a point short of that at which all three said pivot points are in straight alignment along said axis of sliding movement, the tool being open when said first stop means is engaged and closed when said second stop means is engaged.

In order to assure complete deformation of work pieces, my tool may include anti-reversing means restricting movement of said second die member to one direction only when said second die member is at any point between the open and closed positions.

In a useful embodiment my tool includes spring biased means for adding lubrication to at least one pivot site on each cycle of said tool from open to closed and back to open.

In an especially preferred embodiment, the connection for pivotal movement at at least one of said pivot sites includes a cylindrical cross pin affixed to one of the two pivoting members and an ob-round hole formed in the other pivoting member, said cylindrical cross pin having predetermined diameter $D_1$ and having its longitudinal axis congruent with the pivot axis at that pivot site, at least a portion of the length of said cross pin being positioned within said ob-round hole, said ob-round hole having two semicircular ends of predetermined diameter $D_2$ and two parallel straight sides, the width of said ob-round hole being equal to $D_2$, the overall length of said ob-round hole being up to about 1.5 times $D_2$, $D_2$ being from about 1.001 to about 1.01 times $D_1$, said ob-round hole being so oriented that when said tool is in the closed position the long dimension of said ob-round hole is substantially perpendicular to both said pivot axes and said longitudinal axis of said chassis member. Preferably, all three connections for pivotal movement include said cylindrical cross pins and ob-round holes.

In order to provide automatic shifting on demand from pivoting to rolling modes of operation, my tool may preferably include, at each pivot site, spring biasing means biasing said cylindrical cross pin to one end of said ob-round hole when said tool is in the open position, said one end being opposite an end at which said cross pin is located when said tool is in the closed position after having formed a work piece positioned between said mating surfaces of said first and second die members.

In one embodiment, the anti-reversing means comprises (a) a first elongated bar having a longitudinal axis in the direction of the longitudinal axis of said chassis member and having one end pivotably attached to said chassis member at a point spaced a distance from said second die member and a lesser distance from said second pivot site; (b) a second elongated bar having a longitudinal axis parallel to the longitudinal axis of said first bar and having one end pivotably attached to said first toggle arm member at a point between said first and third pivot sites; (c) said first and second bars each having a longitudinal surface, at least a portion of said longitudinal surface of said first bar being in contact with at least a portion of said longitudinal surface of said second bar for sliding movement of said bars relative to each other in the direction of their longitudinal axes, one of said longitudinal surfaces including an enlongated recess in the longitudinal direction, said recess being of uniform depth except for a generally V-shaped transverse wedge protruding toward the other longitudinal surface at the longitudinal center of said recess, the other said longitudinal surface including two transverse spaced apart depressions; (d) means for limiting sliding movement of said first and second bars relative to each other so that said elongated recess is always opposite either one of said transverse depressions or the portion of said other surface between said transverse depressions; (e) a rolling member having circular transverse cross section of predetermined diameter $D_3$ and radius $R_3$ positioned within said elongated recess in said one longitudinal surface and in contact with a point on said other longitudinal surface; (f) spring biasing means within said elongated recess tending to maintain said rolling member in contact with a surface of said V-shaped wedge; and (g) means for maintaining said portions of said longitudinal surfaces in sliding contact and retaining said rolling member and spring biasing means within said elongated recess, wherein the distance between said other longitudinal surface and the tip of said V-shaped wedge is less than $D_3$, the distance between said other longitudinal surface and the deepest surface of said recess is greater than $D_3$, and the distance from the deepest surface of each of said spaced apart depressions to the tip of said V-shaped wedge is greater than $D_3$ when said V-shaped wedge is opposite said depression.

In a preferred embodiment, the anti-reversing means comprises (a) a first elongated bar having a longitudinal axis in the direction of the longitudinal axis of said chassis member and having one end pivotably attached to said chassis member at a point spaced a distance from said second die member and a lesser distance from said second pivot site; (b) a second elongated bar having a longitudinal axis parallel to the longitudinal axis of said first bar and having one end pivotably attached to said first toggle arm member at a point between said first and third pivot sites; (c) said first and second bars each having a longitudinal surface, at least a portion of said longitudinal surface of said first bar being in contact with at least a portion of said longitudinal surface of said second bar for sliding movement of said bars relative to each other in the direction of their longitudinal axes, one of said longitudinal surfaces including an elongated recess in the longitudinal direction, said recess being of uniform depth except for a generally V-shaped transverse wedge protruding toward the other longitudinal surface at the longitudinal center of said recess, the other said longitudinal surface including a series of adjacent transverse scallop-like depressions, each of said depressions except those at each end of said series being of generally arcuate contour, each pair of adjacent depressions of said series meeting at a peak, all said arcuate depressions being of substantially equal depth, the depression at each end of said series being wider in the longitudinal direction and deeper than said arcuate intermediate depressions; (d) means for limiting sliding movement of said first and second bars relative to each other so that said elongated recess is always opposite at least a portion of said series of depressions; (e) a rolling member having circular transverse cross section of predetermined diameter $D_3$ and radius $R_3$ positioned within said elongated recess and in contact with a point on the surface of said series of depressions; (f) spring biasing means within said elongated recess tending to maintain said rolling member in contact with a surface of said V-shaped wedge; and (g) means for maintaining said portions of said longitudinal surfaces in sliding contact and retaining said rolling member and spring biasing means within said elongated recess, wherein the distance from the deepest point of each said arcuate intermediate depression to the tip of said V-shaped wedge is less than $D_3$ when said V-shaped wedge is opposite said arcuate depression, the distance from said peak between any two of said depressions to the deepest surface of said recess is greater than $D_3$ when said peak is opposite said deepest surface, and the distance from the deepest surface of each said depression at each end of said series to the tip of said V-shaped wedge is greater than $D_3$ when said V-shaped wedge is opposite said end depression. In this embodiment I prefer that (a) the depth of each said arcuate depression is about 0.1 $D_3$ and (b) the curved surface of each said arcuate depression has a radius of curvature equal to from $R_3$ to about 1.1 $R_3$ and subtends a predetermined angle of A degrees. In order to totally prevent reverse movement I may provide that the included angle between the sides of said V-shaped transverse wedge be at least $[180-2(A/2+\text{Arc Tan } C)]$ degrees, where C is the coefficient of sliding friction between the surface of said wedge and the surface of said rolling member.

The output force of a tool according to the invention is determined by the work required to be performed and can be charted as a curve of output force vs. tool movement (or workpiece deformation). In the case of forming a rivet head, such a curve will sweep upward exponentially as the area of the rivet head increases during the heading operation. In the case of crimping a sleeve upon the end of a wire, the connection being formed is confined within a crimping nest which prevents growth of area; hence, the force curve will increase substantially linearly until the material of the workpiece deforms to fill all interstices. At this point, the pressure will equal the compressive strength of the materials being joined. The output force curve will then level off as slight continued compression causes the workpiece material to extrude slightly out of the crimping nest resulting in a reduction of cross-sectional area of the workpiece. For the purpose of this disclosure, the output force curve will rise abruptly as the forming die impinges upon the workpiece, and will continue to rise in a straight line upward slope terminating in a short level extension representing the compressive limit of the workpiece materials. Using known force relationships a toggle coefficient can be calculated for each decremental step (abscissa) of the diminishing toggle arm. If the output force at each abscissa is divided by that abscissa's toggle coefficient and the resulting value marked upon the same abscissa according to a selected reduced force scale, an input force curve can be plotted. Such a plot shows that a peak input force occurs intermediate the curve ends and diminishes thereafter (similar to a trajectory curve) although the output curve continues upwardly. The peak input force may be arbitrarily established or it may be subjectively judged to be within acceptable limits. In either case, a linkage can be developed to satisfy the desired output/input ratio. The forces on the abscissas for the input peak and the output maximum are pertinent for stress and vector analysis of the associated tool elements and functions.

The toggle coefficient is not pursued to infinity, i.e., the toggle linkage is mechanically stopped before its pivot points come into straight alignment.

BRIEF DESCRIPTION OF THE DRAWINGS

In the accompanying drawings,

FIG. 9 is a simplified diagram of a basic unequal arm toggle in normal orientation, and is included for illustrative purposes in connection with calculations discussed hereinbelow;

FIG. 10 is a simplified diagram of a toggle linkage according to the invention with force and dimensional elements identified for deriving data pertinent to the invention;

FIG. 11 illustrates an output/input force relationship curve in a toggle according to the invention.

DETAILED DESCRIPTION OF THE PREFERRED EMBODIMENTS

Figure 2:
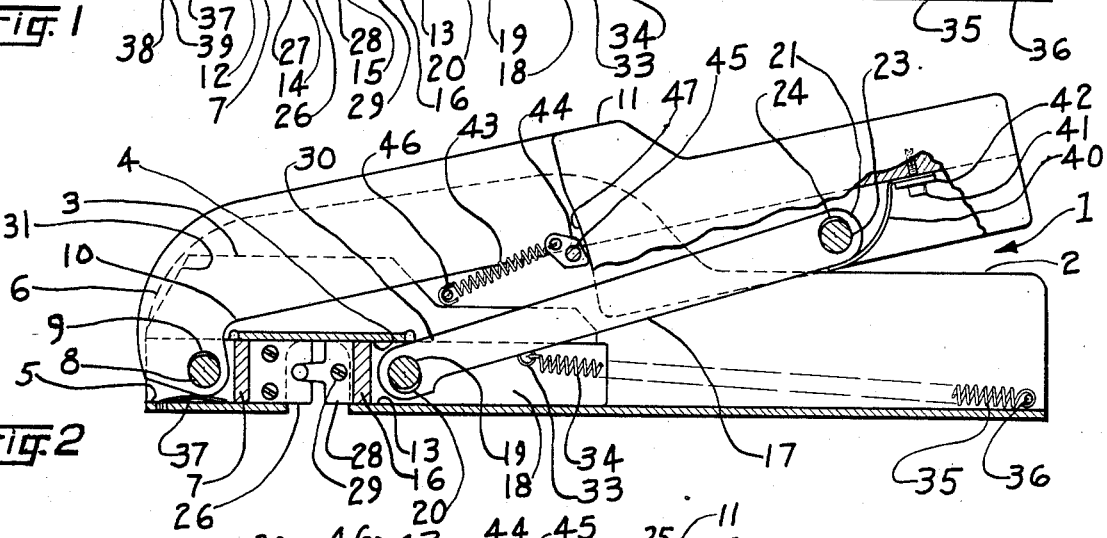
FIG. 2 is a side elevation of the tool of FIG. 1 showing the tool partially closed with the crimping heads in position to impinge upon a workpiece.
Figure 3:
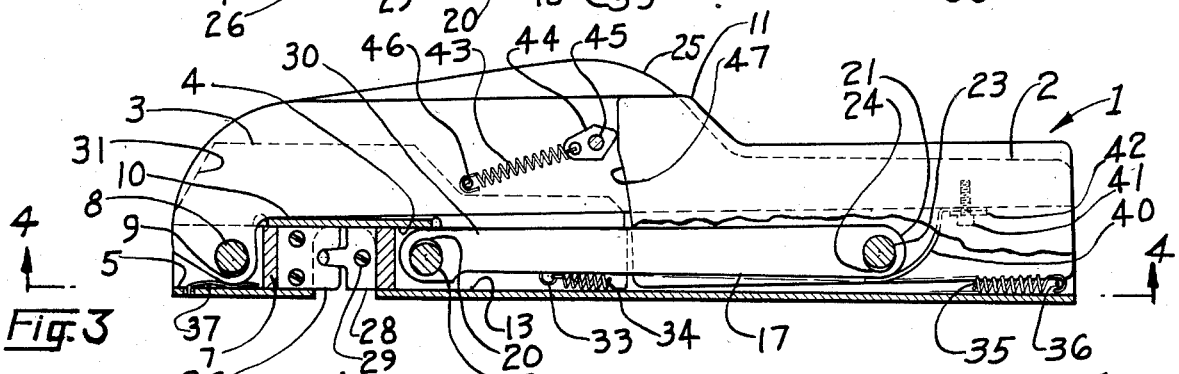
FIG. 3 is a side elevation of the tool of FIG. 1 showing the tool in the fully closed position wherein the toggle linkage produces its maximum force.
Figure 4:
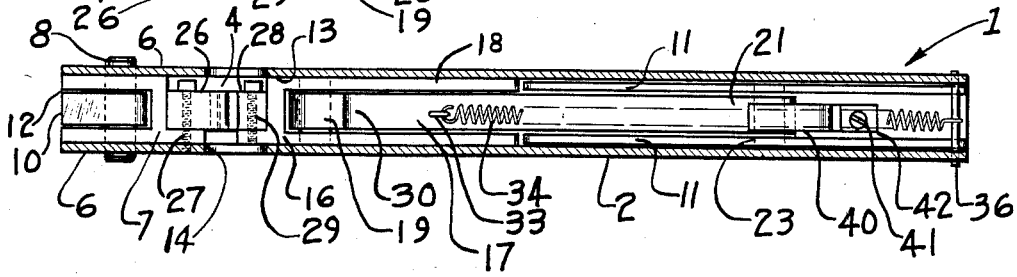
FIG. 4 is a bottom view of the tool of FIG. 3 taken along the line 4—4 of FIG. 3 and illustrating the nesting relationship of various tool components.

With more particular reference to the accompanying drawings, in which like numbers refer to like parts, FIGS. 1 through 4 illustrate a crimping tool according to the invention. The tool has a channel form chassis member 2 having fixed within it another channel form member 3 the web 4 of which cooperates with chassis member 2 to form a rectangular section tunnel 5 with near and far sidewalls 6. A crimping head holder 7 is fixed within the end portion of tunnel 5 by means of a hardened pin 8 press fitted in chassis member 2; pin 8 also passes through an ob-round hole 9 in the "C" frame end 10 of handle member 11, pivotally retaining the end 10 within the clevis 12 of holder 7. A rectangular tunnel 13 is a continuation of tunnel 5 having been interrupted by cutout portion 14, 15. A slidable crimping head holder 16 is positioned within tunnel 13 and pivotally connected at its clevis portion 18 to one end of toggle strut 17 by means of hardened pin 19 through an ob-round hole 20 in strut 17. The other end 21 of strut 17 is pivotally connected in the clevis portion 22 of handle 11 by means of another hardened pin 23 press fitted in handle 11 but pivotally operative in strut end 21 through ob-round hole 24. Upstanding flanges 25 of chassis channel 2 prevent entrapment of a worker's fingers thereby guarding against injury. A fixed crimping head 26 is fastened to fixed holder 7 by means of screws 27 which may protrude through chassis sidewall 6 as shown in FIG. 4. A movable crimping head 28 is fastened to slidable holder 16 by means of screw 29. Crimping heads 26 and 28 cooperate, when fully engaged, to deform a wire inserted in the wire barrel of a wire terminal so that a secure attachment is permanently produced between the wire and its terminating piece. The crimping heads 26 and 28 could be integral with the holders 7 and 16, but the arrangement shown permits interchangeability of crimping heads and also allows adjustment with shims if necessary. The web 4 of inner channel part 3 does not extend to either end of the part 3 so as to avoid interference with the "C" frame portion 10 of handle 11 and the end 30 of toggle strut 17. The remaining sidewall extensions 31 and 32 provide positioning for holder 7 and tracking guidance for slidable holder 16. A staple-like wire loop 33 is fixed near end 30 of strut 17 to serve as an anchor point for one end of a return coil spring 34. The other end 35 of the spring is anchored by means of a cross pin 36 press fitted in holes in the sidewalls of chassis 2. At the nose of the tool 1 a bowed leaf spring 37 is held in position by tab 38 engaged in hole 39 in chassis 2. At the tail end 21 of toggle strut 17 another bowed leaf spring 40 is held in position by means of screw 41 and rectangular washer 42. Near the center of the tool a coil spring 43 has one end attached to a sprag 44 pivotally mounted on pin 45 in sidewall 6 of chassis 2; the other end of spring 43 is anchored by pin 46, also fixed in the sidewall 6 of chassis 2. Spring 43 urges the sprag into frictional engagement with a true arcuate edge surface 47 which is part of handle 11. The arc of surface 47 is described about the center of pin 8. It will now be noted that the bias springs 37 and 40 and the biasing effect of the return spring 34 serve to position the ob-round holes 9, 20 and 24 in the off-center relationship shown with their respective pivot pins 8, 19 and 23. This off-center relationship will be maintained and pins 8, 19 and 23 will slip, as in a sleeve bearing, while the tool is closing under a no-load condition and until crimping head 28 impinges upon a workpiece positioned within crimping head 26. At impingement, an increasing bearing load begins to occur between pins 8, 19 and 23 and their respective ob-round holes 9, 20 and 24. When this bearing load becomes great enough to overwhelm the biasing capability of leaf springs 37, 40 and the geometrically diminishing bias effect of coil spring 34, pins 8, 19 and 23 develop traction within their ob-round holes 9, 20 and 24 and the relative turning motion is transferred to rolling rather than slipping. Thus, an increasing load on the toggle linkage causes the mode of operation to transfer automatically, upon demand, from a pivotal to an almost frictionless rolling mode. With this feature a much greater rolling load capacity is provided by the relatively large diameter pins 8, 19 and 23 than could be provided by needle bearings surrounding the same diameter pins, as the capacity with needle bearings would be limited by the basic dynamic capacity of the needle bearings. It will be evident that the initiation of the pivot "rolling action on demand" is related to the tension of the bias springs that bias the pivot pins to the primary ends of the ob-round holes; i.e., the greater the bias tension, the later the rolling action starts and the less rolling action takes place.

Figure 1:
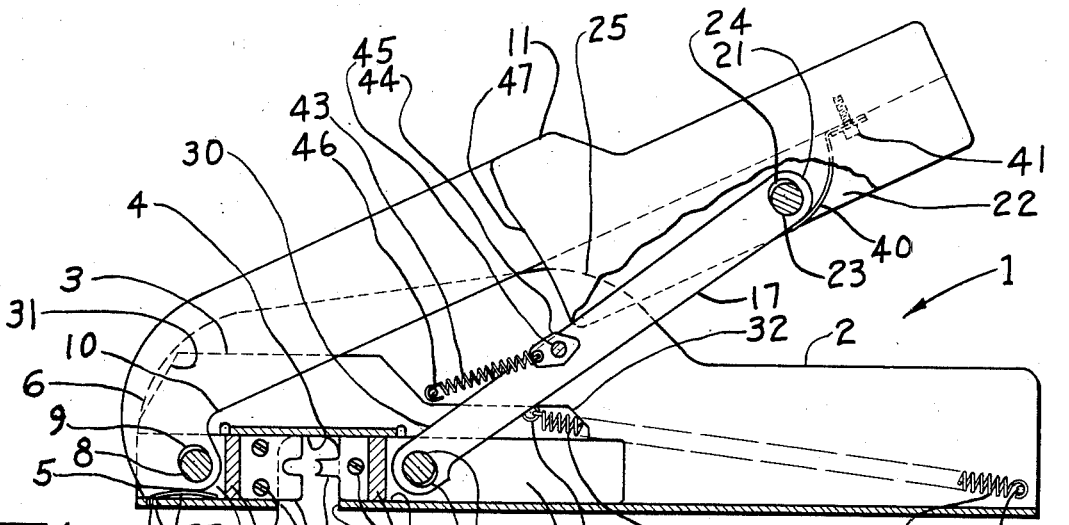
FIG. 1 is a side elevation, with portions cut away for clarity, of a plier type crimping tool in the full open position showing one embodiment of a toggle linkage according to the invention.

Referring now to FIG. 2, it will be noted that partial closure of the tool 1 has closed the crimping heads 26, 29 such that a workpiece would be captive in their grip. At this point the tool has not yet undergone its transformation from pivotal to rolling mode as witnessed by the same pin/ob-round hole (8, 9; 19, 20; 23, 24) relationship as appeared in FIG. 1. It will also be noted that the sprag 44 has assumed an angular position dictated by its engagement with the arcuate edge element 47 which has swung into its present position as the tool became partially closed. The angle that sprag 44 makes with a radius of arc 47 is the "pressure angle" and is shown here exaggerated. As is well-known in the art, in order to have a zero back-lash, non-slip sprag function the pressure angle must be arranged so that its tangent is equal to or less than the coefficient of friction between the associated parts 44 and 47 (the contacting surfaces of 44 and 47 are preferably hard enough to resist brinelling and wear). By choosing a pressure angle with a tangent slightly above the coefficient of friction, a reversing sprag function can be obtained in which the moving surface 47 slips very easily in one direction—e.g. the direction of tool closure but with considerable difficulty in the reverse direction—e.g. the direction of tool opening. In the position shown in FIG. 2, the sprag serves the desired function of insuring complete tool closure—i.e., certifies a valid crimp—while still allowing the tool to be forced open without damage should it be necessary to remove a mal-positioned workpiece. In use a crimping tool is normally completely closed for each crimp and the sprag function, though present, is not noticed. The sprag comes into play only if the tool operator fails to completely close the tool. An alternative reversing ratchet sometimes used in prior art crimping tools includes a spring-centered pawl cooperating with a toothed rack; this arrangement, which cannot be forced open without damage to the parts, is also commonly used in vending machine coin slide mechanisms.

FIG. 3 shows the tool 1 completely closed. The "C" frame 10 is just deep enough to clear the inside web of channel 3. During the final closing phase, the following events occur: handle 11 stops at pin 36 preventing the centers of pins 8, 19 and 23 from coming into common alignment; crimping heads 26 and 28 achieve their design closure so as to complete the prescribed crimp upon a workpiece; the spring centered reversing sprag 44 completes its traverse of arcuate surface 47 and, at closure, assumes a centered position from which it will take a position opposite that of FIG. 2 on opening the tool and thus allow the tool to be opened easily; bias springs 37, 40 and the biasing effect of spring 34 are overcome by the traction of ob-round holes 9, 20 and 24 rolling upon their pins 3, 19 and 23 as demonstrated by the deflection appearing in leaf spring 37; and very importantly, the pin-slot rolling action actually takes place as demonstrated by the slot end clearance migrations to the opposite sides of pins 8, 19 and 23. An added interesting feature of the tool of FIG. 1 is that return spring 34 extends only slightly throughout the entire closure, indicating that it can be a high rate (heavy preload) spring with low rate (small active deflection) characteristics to insure against fatigue. FIG. 4 shows the clevis arrangement of the "C" frame element 10 of handle 11 disposed within clevis 12 of crimping head holder 7, the disposition of end 30 of toggle strut 17 within the clevis portion 19 of slidable crimping head holder 16, and the straddling relationship of the sides of handle 11 with the other end 21 of toggle strut 17. It can also be seen that the mounting screws 27 of the fixed crimping head 26 extend through the wall 6 of chassis 2 (and could even protrude more should it become desirable to mount a crimped workpiece alignment fixture); however, mounting screw 29 of the movable crimping head 28 cannot protrude beyond the surface of head holder 16 because if it does protrude it interferes with the reciprocating motion of head holder 16 within the tunnel portion 13 of chassis 2 in combination with fixed wall 4 of channel member 3. Although not shown as such, members 2 and 3 may be fixed to each other by means of riveting, spotwelding, soldering, brazing, or the like.

Referring now to FIGS. 5 through 8, there is shown another preferred embodiment of a toggle operated tool designated generally 51, which uses the same basic toggle linkage system as the tool described in FIGS. 1 through 4. In this embodiment, however, a trade-off has been made; instead of having the head pin positioned in an ob-round hole where rolling action can occur, the pin pivots in a bearing bore with an automatic lubrication replenishment system described later. The tool of FIGS. 5 through 8 has a channel form chassis member 52 with upstanding sidewalls 53 and 54. Fixed within chassis 52 is channel form member 55 having upstanding sidewalls 56 and 57 in faying relationship with 53 and 54. The channel assembly just described is pivotally fastened in opposed relationship to a shell form member 59 by means of a hardened pin 58. Shell form member 59 has sidewalls 60 and 61 and end wall 62. The near sidewalls 53 and 57 are coped out as shown at 63, 64 to accept, in nesting fashion, a control linkage 65 more fully described later. The sidewalls 60 and 61 are coped out at 66 and 67 to form a "C" frame member. The depth of this coping need only clear the widest workpiece with which the tool is to be used and the coping is thus shallower than the coping in member 10 of the tool of FIGS. 1 through 4. This shallow "C" frame 66, 67 allows member 59 to be lighter than "C" frame 10 of FIGS. 1 through 4 while having equivalent strength. In order to avoid having ob-round holes in the head end of sheet metal "C" frame where they would be vulnerable to the entrance of foreign particles, and finding that it may be impracticable to transpose the pin-slot function into the fixed crimping head holder 68 because of a spring biasing problem, a trade-off was adopted. The hard pin 58 is press fitted into "C" frame area 60', 61' of shell 59 and has a running fit with a hole 69 through holder 68. Note that the bearing area in holder 68 is not diminished by a clevis cut and therefore provides a generous area for the lubricated pin 58 to bear upon. To lessen the compromise of the trade-off, an oil hole 70 is provided and is filled with an oil saturated felt wick 71. A leaf spring 72 covers the oil hole 70 and also urges pin 58 against the unloaded sidewall 69' of hole 69 so that the lubrication film that is present is automatically displaced to the opposite (work load) side of the bearing hole whenever the tool is unloaded. Thus, the bearing is relubricated on its load bearing surfaces prior to each work cycle. Although the load is heavy, the durability of the hardened parts should be satisfactory since the rotary motion (surface velocity) is very slow and the angular displacement (peripheral travel) is short. Of course, an alternative to the lubricated head bearing and pivot pin may be to fix the head pin against rotation in the handle shell and to provide an ob-round slot through the frame and stationary crimping head holder (block) for the pivot pin to roll in when rolling is initiated by the demand of the workload. As the head pin rolls in the ob-round slot, the toggle linkage geometry changes slightly and, in effect, experiences an imperceptible decrease in force multiplication.

Figures 5, 6, 7, 8:
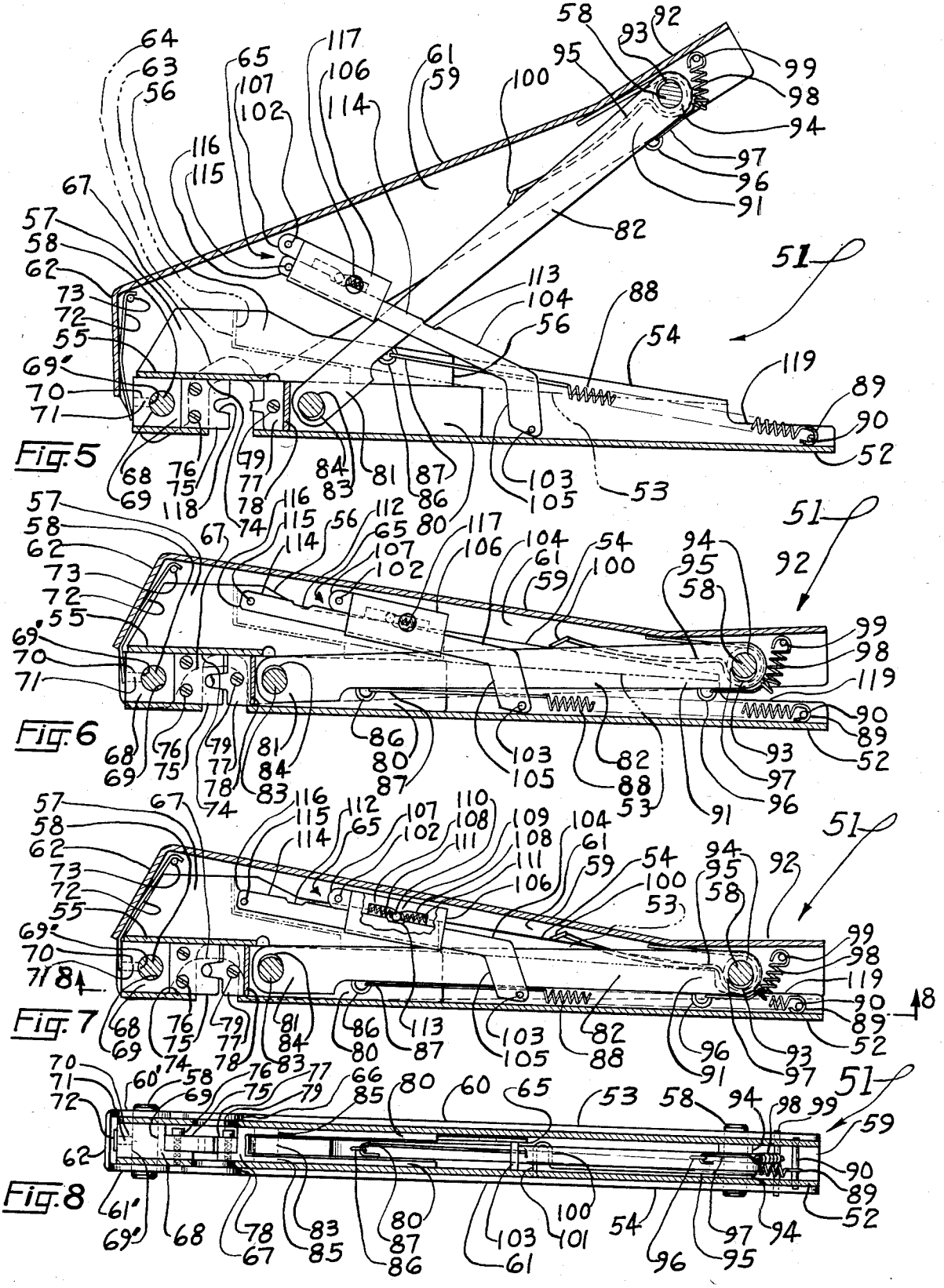
FIG. 5 is a side interior elevation of another fully open plier type crimping tool embodying a toggle linkage according to the invention and including a novel anti-reversing ratchet assembly.
FIG. 6 is a side interior elevation of the tool of FIG. 5 showing the tool in nearly closed position just as a kick-open spring transfers its tip bearing from the toggle strut to the edge of the sidewall.
FIG. 7 is a side interior elevation of the tool of FIG. 5 in its fully closed position wherein the toggle linkage produces its maximum force according to the invention.
FIG. 8 is a bottom interior view of the tool of FIG. 7 taken along the line 8—8 of FIG. 7., illustrating the nesting relationships of various tool components and the relation of the kick-open spring to the toggle strut and chassis sidewall edge.

Spring 72 is retained in place by its engagement over a cross pin 73 press fitted in holes in sidewalls 60 and 61 of shell member 59. Channel 55 fixed within channel 52 provides a rectangular section tunnel 74 which houses a fixed crimping head holder 68. A crimping head 75 is mounted to holder 68 by means of screws 76 which pass through but not beyond sidewall 54 of chassis 52, as seen in FIG. 8. A slidable crimping head holder 78 reciprocates within tunnel 74, and a crimping head 77 is mounted to the slidable holder 78 by means of screw 79. Crimping heads 75 and 77 are shown as inserts but could, alternatively, be integral with the holders 68 and 78. The back end of the slidable holder 78 has a clevis portion 80 to cooperate with end 81 of toggle strut 82 in a pivotal manner by virtue of hardened pin 83 in ob-round hole 84. The pin 83 may be a light push fit in holes 85 in clevis portion 80 of toolholder 78 (FIG. 8). Near one end 81, strut 82 holds a staple-like wire loop 86 to engage the extended end hook 87 of a return (tool opening) spring 88. The other end 89 of spring 88 is hooked around a pin 90 press fitted in holes in sidewalls 56 and 57 of chassis 52. The other end 91 of toggle strut 82 is pivotally connected to the shell 59 in handle zone 92 by means of another hardened pin 58 press fitted in holes in the side walls of handle zone 92 and passing through an ob-round hole 93 in end 91 of strut 82. At end 91, strut 82 is centrally located between the sidewalls 60 and 61 of shell 59 by means of tubular spacers 94. A "kick-open" hairpin spring 95 partially surrounds and is thereby anchored upon one of the spacers 94. Also, at end 91 of strut 82 there is another staple-like loop 96 which engages one end 97 of a bias spring 98; the other end of spring 98 is anchored to a cross-pin 99 press fitted in holes in the sidewalls 60 and 61 of the shell's handle portion 92. As shown in FIG. 8, the working end of hairpin spring 95 is shaped into hook 100, the straight end 101 of which extends to the inner surface of sidewall 61 so as to overlie the edge of sidewall 54 for a purpose to be described later.

A reversing ratchet control linkage 65 includes a flat bar 104 with an offset end 105, a short extension bar 107 and a channel-form cage member 106 fixed to bar 107. The offset end 105 of bar 104 is pivotally secured to sidewalls 53 and 54 of chassis 52 by means of cross pin 103 pressed into holes in the sidewalls, while the end of bar 107 is pivotally secured to sidewalls 60 and 61 of shell 59 by means of cross pin 102 pressed into holes in those sidewalls. Bar 104 slip fits through the channel form cage member 106 in sliding relationship to the extension bar 107. Bar 107 has an elongated recess 108 in the portion of its one edge within cage 106, and the recess 108 has a raised transverse "VEE" wedge 109 at its midpoint. A sprag roller 110 and centering springs 111 are positioned within recess 108, the spring serving to position roller 110 in the center of recess 109 whenever one of notches 112 and 113, cut in the faying edge 114 of bar 104, is opposite the protuberant wedge 109. Notches 112 and 113 are so spaced on bar 104 that the described centering action occurs at each end of the tool stroke as occasioned by the telescoping in and out of bar 104 through cage 106. Excessive extension (tool opening) is prevented by a short protruding cross pin 115 in the free end 116 of bar 104. An offcenter hole 117 in one side of cage 106 permits easy assembly and disassembly of the sprag roller 110 and its centering springs 111.

FIG. 5 shows the tool 51 in wide open position as limited by the pin 115 of ratchet control linkage 65. In use, a work piece (not shown) is located within the shaped recess 118 in the fixed crimping head 75 and the tool is closed until the movable crimping head 77 gently touches and captures the workpiece within recess 118. After a stripped wire to be terminated (not shown) is inserted and held in place in the workpiece the tool is closed until the chassis edges 119 are stopped against the tubular spacers 94 (FIG. 7). As the tool is closed the following events occur: bar 104 slides through cage 116 and its notch 112 will move the sprag roller 110 away from its central position and against one of its centering springs 111. Once this happens, the motion cannot be reversed (allowing the tool to open prematurely) until closure is complete because such reversal would immediately cause sprag roller 110 to wedge against one slope of the wedge 109 thus effectively locking the action. In order for this zero-backlash, non-slip wedging action to occur, the tangent of the pressure angle between the roller 110 and the wedge 109 must be equal to or less than the coefficient of friction between the hardened parts. The closing action continues under practically a no-load condition until crimp head 77 impinges upon the workpiece. During this phase, bias spring 98 and the biasing function of return spring 88 hold the pins 58 and 83 in the relationship shown in FIG. 5, with pin 83 at one end of ob-round hole 84 and pin 58 at one end of ob-round hole 93; in this phase of operation pins 83 and 58 simply rotate lightly at one end of their respective ob-round holes (lubrication, low speed, no load, no wear). During the same phase, the hairpin "kick-open" spring 95 is subject to gradual loading by virtue of its engagement over toggle strut 82; the third order leverage in this action is so great that the spring loading effect at handle 92 is virtually imperceptible. When the movable crimp head 77 impinges upon the workpiece, the second phase of motion begins and the tool experiences a work load. This loading is felt at the toggle pivot pins 58 and 83 resulting in traction in the ob-round holes 84 and 93 so that from here on the pivoting action in these holes is purely a rolling action. The bearing surfaces of the ob-round holes are hardened by known means to minimize rolling friction and wear. On experiencing the working load, the small clearance between the pin 58 and its bearing bore 69 is transferred from one side of the pin to its opposite side against the resistance offered by bias leaf spring 72; it is at this time of hole clearance transfer that the above-mentioned hole relubrication feature functions.

FIG. 6 shows the tool at nearly closed position. It will be noted that the pin/ob-round hole relationships have already reversed indicating that the purely rolling action is in progress. At the point shown in FIG. 6, tip 101 of hairpin spring 95 has its bearing transferred from strut 82 to the upper edge of sidewall 54, where it can exert its full force to kick the tool open once the full closure has been achieved and the operator's grip has relaxed. The transfer of spring tip 101 occurs so late in the action that the tool's peak squeezing force (input curve) has long since been passed; thus the late additive effect of the spring 95 is negligible and the descending end of the input curve stays well below its aforementioned peak. An additional feature of the dual engagement of spring 95 between strut 82 and sidewall 54 is that spring 95 never emerges from the protection of handle zone 92 and is thus not exposed to snagging or damage.

FIG. 7 shows the tool at full closure. The sprag roller 110 is recentered within notch 113 in bar 104 so that tool opening can now take place and the completed work piece removed from the tool. During opening of the tool, bias leaf spring 72 retransfers the hole clearance at pin 58 and relubrication occurs. Also, the hairpin spring tip 101 transfers from the edge of wall 54 back onto the strut 82 and its spring effect is accordingly diminished by the third order leverage of strut 82.

FIG. 8 is an upward looking internal plan arrangement showing the interrelationship of the parts and the broad uninterrupted bearing surface of hole 69 which appears in hatched lines. The hardened pin 58 may be pressfitted into the sidewalls 60 and 61 of shell 59 as shown or it may be fitted with spring retaining rings in suitable grooves.

Figure 12:
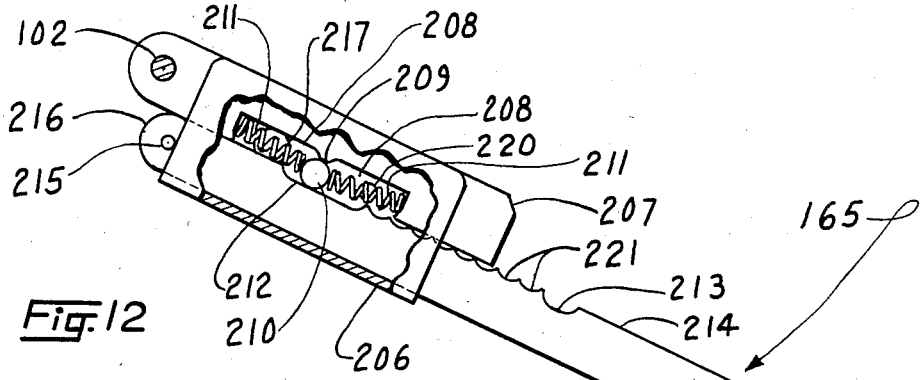
FIGS. 12, 13 and 14 are partially cut away side views of three different positions of a novel alternate anti-reversing ratchet assembly similar to that in the tool of FIGS. 5 through 8.
Figure 13:
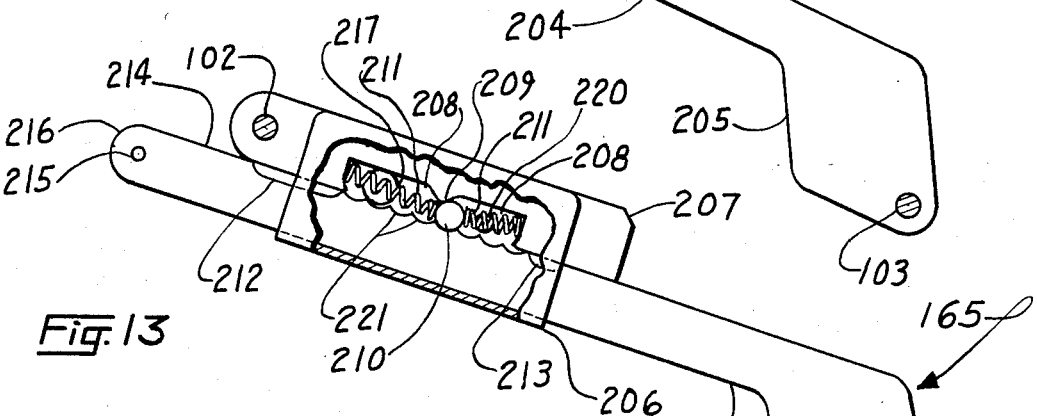
Figure 14:
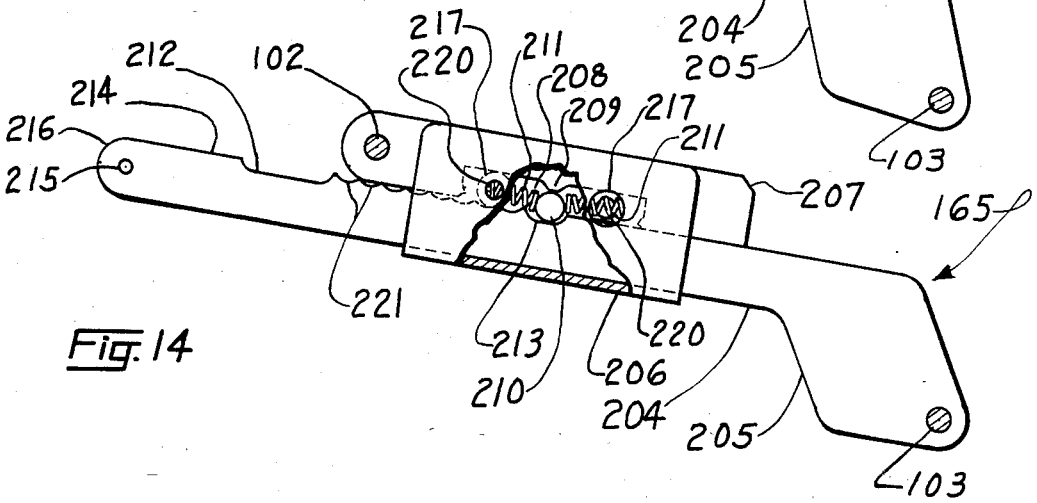

FIGS. 12, 13 and 14 show in three positions a novel preferred ratchet control linkage 165, the overall dimensions, parts and connecting relationships of which correspond to those of linkage 65 shown in FIGS. 5 through 7. When used in tool 51 of FIGS. 5 through 7, linkage 165 is mounted on pins 102 and 103, which are shown in FIGS. 12 through 14 for reference. It will also be noted during the following description that many of the features of linkage 65 appear in identical form in linkage 165.

The linkage 165 includes a flat bar 204 which has an offset end 205 and a series of scallop-like transverse depressions, including deep depressions 212, 213 and shallow intermediate arcuate depressions 221, cut into its faying edge 214. Bar 204 slip fits through a channel form cage member 206 which is fixed to and encloses a short extension bar 207. Pin 215, inserted through end 216 of bar 204, prevents the bar from sliding out of cage 206 and also limits the extension of linkage 165. Bar 207 has an elongated recess 208 in its inner edge; at the midpoint of the recess is a raised transverse "VEE" wedge 209. A roller 210 and centering bias springs 211 are positioned within the recess 208. When the arcuate depressions 221 are opposite the wedge 209 (see FIG. 13), the roller 210 cannot pass under the "VEE". However, when one of the deep depressions 212 and 213 comes opposite wedge 209 (see FIGS. 12 and 14), the roller 210 can underpass the wedge, thus allowing a reverse travel of the bar 204 through cage 206. It is preferred that the springs 211 be at their free length (no preload) when roller 210 is centered; in fact, the springs 211 need not actually touch roller 210 at that point. With this arrangement travel reversal can occur only at the fully extended or contracted modes of linkage 165, i.e. at stroke completion. As was the case with linkage 65, this insures that the tool 51 cannot be reopened until it has fully compressed a workpiece in the tooling recess 118 to its specified size.

When the linkage is telescoping in one direction, roller 210 bears against one of bias springs 211. The spring yields to allow the roller to cam from scallop to scallop 221; thus, a stepping ratchet obtains. In the event of an attempted stroke reversal when the roller is over an arcuate depression, the bias spring causes the roller to jam immediately between the wedge and whichever depression is under the roller at the time.

Holes 217 in the sidewalls of cage 206 permit installation and removal of roller 210 and springs 211. Smaller holes 220 opposite holes 217 admit a probe tool (not shown) to eject the roller 210 if necessary for disassembly.

Calculations and experiments with the linkage of FIGS. 12 through 14 have shown that, given a diameter $D_3$ and radius $R_3$ of roller 210, the following relationships can be stated:

(a) The preferred relative dimensions for the arcuate depressions 221 are depth about $0.1D_3$ and radius of curvature $R_3$ to about $1.1\ R_3$; with these relative dimensions each depression subtends an angle A of about 76 to 80 degrees.

(b) In order to totally prevent unwanted reversal, i.e. to cause the roller 210 to jam immoveably if reverse movement is attempted, the angle included between the sides of the "VEE" wedge 209 must be at least $[180-2(A/2+\text{Arc Tan } C)]$ degrees, where A is the angle subtended by each of the arcuate depressions 221 and C is the coefficient of friction between the surface of wedge 209 and the surface of roller 210. Smaller included angles will allow reversal of movement, albeit with much greater effort than movement in the forward direction.

FIG. 9 is a basic diagram of classic unequal arm toggle mechanics, in which F2 represents input force, P2 represents output force (more precisely, reaction to output forces) and the relationship between the two is shown in the formula for P2 set forth. The basic relationships of FIGS. 9 were used to derive the information shown in FIG. 10, which illustrates and applies to crimping tools embodying toggle linkages according to the invention. In FIG. 10, P represents the output or crimping force resulting from application of input force $F_1$, to the grips or handles of the crimping tool. Also, in FIG. 10, as in FIG. 9, the toggle coefficient is equal to aa/bb.

Referring to FIG. 10, two short "extension leverage" arrows will be seen emanating from the tip of arrow "$F_1$". One arrow is normal to an extension of leg "b" and the other is normal to an extension of leg "c". The extended arrow of "$F_1$" bisects the angle formed by the aforementioned short arrows and intersects an extension of leg "b" at a point spaced from the apex of angle "A" by a distance equal to that between "$F_1$" and the apex of angle "A". It is assumed that the "grip points" of any plier-like tool are preferably equidistant from the pivot point.

Sides "b" and "c" (handles) may be extended as desired to increase the input leverage.

When the size of product being crimped or staked and the force required to properly perform the desired work are known, along with basic dimensions of the toggle linkage being used (e.g. leg lengths a, b and c), FIGS. 9 and 10 and their associated formulas can be used to develop force/displacement curves such as are shown in FIG. 11. FIG. 11 is a plot of force/displacement obtained from one crimping tool according to the invention. It should be noted in FIG. 11 that the length of arm "b" decreases as crimping progresses—i.e. as the distance between crimping heads (e.g. 26 and 29 in FIG. 1) decreases.

In FIG. 11, dividing the output force at any abscissa by the toggle coefficient for that abscissa results in a figure equal to the input force for that abscissa, which can then be entered as a point on the input curve. After input force values for a number of abscissa have been so derived, an input curve can be plotted. For the tool to which FIG. 11 applies it will be noted that peak input force occurs just past the midpoint of the input curve; it is thus apparent that a late acting "kick-open" spring force of, for example, two pounds more or less will not be significant during the latter descent of the curve.

Selection of dimensions and materials for tools according to the invention is deemed to be well within the purview of skill in the art and is based on the size of the tool, the force necessary to properly crimp and the linkage functional requirements discussed above. In designing and fabricating a crimping tool according to the invention, toggle arm lengths are established for the appropriate series of coefficients to deal with the given output force requirement. The stroke from open to closed position must provide adequate opening space to admit the given workpiece and the tool should have a "handle-open" span small enough for a comfortable hand grip. Desirably the angles "A", "B" and the complement of "C" (FIG. 10) are noted at the instant when the load induces traction in the ob-round pivot holes, and rolling displacement can then be made equal in degrees to angular displacement at the respective pivots. Rolling, sliding and static bearing pressures and stress analysis of all elements may be calculated for each linkage considered in order to verify its validity. The return (opening) spring should be so sized that it does not itself induce enough loading to overcome the bias springs' function and initiate premature pivot traction. Finally, the relubrication feature of FIGS. 5 through 8 can if necessary be used at one or all of the toggle pivot joints. All such considerations are deemed to be within the skill of a competent mechanical design engineer and are therefore not discussed in detail here.

While I have shown and described certain present preferred embodiments of the invention, it is to be distinctly understood that the invention is not limited thereto, but may be otherwise variously embodied within the scope of the following claims.

I claim:

1. A diminishing arm toggle linkage tool comprising:

(a) an elongated chassis member;

(b) first and second elongated force applying members having their longitudinal axes aligned, said force applying members each having an inner and an outer end, said inner ends being adjacent to each other on the axial line, said force applying members being mounted on said chassis member for axial movement toward and away from each other between a closed abutting position and an open spaced apart position to thereby define a work space between said inner ends which diminishes axially when said force applying members are moved toward each other;

(c) a third elongated member attached for pivotal motion at its one end to a point on said second force applying member spaced from said inner end thereof;

(d) a fourth elongated member attached for pivotal motion at its one end to a point near said outer end of said first force applying member;

(e) the other end of said third member being attached for pivotal motion to said fourth member at a point spaced from said one end of said fourth member;

(f) the distance between attachment points on said third and fourth members respectively defining first and second toggle arms;

(g) the distance between the attachment point on said first force applying member and the attachment point on said second force applying member defining a third toggle arm, the length of which varies by the distance from open to closed positions of said first and second force applying members; and (h) the length of said second toggle arm being substantially equal to the length of said first toggle arm plus the length of said third toggle arm in said closed position.

2. A tool for forming a work piece to a predetermined shape and size, comprising:

(a) an elongated chassis member;

(b) a first die member fixedly mounted in said chassis member near a first end of said chassis member;

(c) a second die member mounted in said chassis member for sliding movement toward and away from said first die member establishing closed and open positions respectively along a common axis which is parallel to the longitudinal axis of said chassis member;

(d) said first and second die members having complementary mating surfaces shaped so that when said mating surfaces meet in said closed position they form a cavity having such predetermined size and shape of such work piece;

(e) a first elongated toggle arm member having one end connected for pivotal movement to said first end of said chassis member at a first pivot site; and (f) a second elongated toggle arm member having one end connected for pivotal movement to said second die member at a second pivot site and the other end connected for pivotal movement to said first toggle arm at a third pivot site spaced from said one end of said first toggle arm, wherein the distance between pivot sites on said first toggle arm is substantially equal to the distance between pivot sites on said second toggle arm plus the distance between the pivot site on said chassis and the pivot site on said second die member when said mating surfaces of said die members are tightly abutting is said closed position, and wherein each pivot site includes a pivot axis which is perpendicular to said longitudinal axis of said chassis member, all said pivot axes being parallel to one another.

3. A tool as claimed in claim 2 including first stop means comprising means located respectively on said first toggle arm and said chassis operatively connected for limiting to a predetermined length the distance by which said second die member can be moved away from said first die member and second stop means comprising means located respectively on said first toggle arm and said chassis operatively connected for stopping movement of said second die member towards said first die member at a point short of that at which all three said pivot points are in straight alignment along said axis of sliding movement, the tool being open when said first stop means is engaged and closed when said second stop means is engaged.

4. A tool as claimed in claim 3 including anti-reversing means comprising third means located on said chassis and fourth means located on said first toggle arm, said third and fourth means operatively connected for restricting movement of said second die member to one direction only when said second die member is at any point between the open and closed positions.

5. A tool as claimed in claim 2 including spring biased means located adjacent at least one pivot site for adding lubrication to said at least one pivot site on each cycle of said tool from open to closed and back to open.

6. A tool as claimed in either of claims 2 or 4, wherein the connection for pivotal movement at at least one of said pivot sites includes a cylindrical cross pin affixed to one of the two pivoting members and an ob-round hole formed in the other pivoting member, said cylindrical cross pin having predetermined diameter $D_1$ and having its longitudinal axis congruent with the pivot axis at that pivot site, at least a portion of the length of said cross pin being positioned within said ob-round hole, said ob-round hole having two semicircular ends of predetermined diameter $D_2$ and two parallel straight sides, the width of said ob-round hole being equal to $D_2$, the overall length of said ob-round hole being up to about 1.5 times $D_2$, $D_2$ being from about 1.001 to about 1.01 times $D_1$, said ob-round hole being so oriented that when said tool is in the closed position the long dimension of said ob-round hole is substantially perpendicular to both said pivot axes and said longitudinal axis of said chassis member.

7. A tool as claimed in claim 6 wherein all three connections for pivotal movement include said cylindrical cross pins and ob-round holes.

8. A tool as claimed in claim 7, further including, at each said pivot site, spring biasing means biasing said cylindrical cross pin to one end of said ob-round hole when said tool is in the open position, said one end being opposite an end at which said cross pin is located when said tool is in the closed position after having formed a work piece positioned between said mating surfaces of said first and second die members.

9. A tool as claimed in claim 4 wherein said anti-reversing means comprises:

(a) a first elongated bar having a longitudinal axis in the direction of the longitudinal axis of said chassis member and having one end pivotably attached to said chassis member at a point spaced a distance from said second die member and a lesser distance from said second pivot site;

(b) a second elongated bar having a longitudinal axis parallel to the longitudinal axis of said first bar and having one end pivotably attached to said first toggle arm member at a point between said first and third pivot sites;

(c) said first and second bars each having a longitudinal surface, at least a portion of said longitudinal surface of said first bar being in contact with at least a portion of said longitudinal surface of said second bar for sliding movement of said bars relative to each other in the direction of their longitudinal axes, one of said longitudinal surfaces including an elongated recess in the longitudinal direction, said recess being of uniform depth except for a generally V-shaped transverse wedge protruding toward the other longitudinal surface at the longitudinal center of said recess, the other said longitudinal surface including two transverse spaced apart depressions;

(d) means located respectively on said chassis, said first and second bars, and said first toggle arm and operatively connected for limiting sliding movement of said first and second bars relative to each other so that said elongated recess is always opposite either one of said transverse depressions or the portion of said other longitudinal surface between said transverse depressions;

(e) a rolling member having circular transverse cross section of predetermined diameter $D_3$ and radius $R_3$ positioned within said elongated recess in said one longitudinal surface and in contact with a point on said other longitudinal surface;

(f) spring biasing means within said elongated recess tending to maintain said rolling member in contact with a surface of said V-shaped wedge; and (g) means located on said second bar for maintaining said portions of said longitudinal surfaces in sliding contact and retaining said rolling member and spring biasing means within said elongated recess, wherein the distance between said other longitudinal surface and the tip of said V-shaped wedge is less than $D_3$, the distance between said other surface and the deepest surface of said recess is greater than $D_3$, and the distance from the deepest surface of each of said spaced apart depressions to the tip of said V-shaped wedge is greater than $D_3$ when said V-shaped wedge is opposite said depression.

10. A tool as claimed in claim 4 wherein said anti-reversing means comprises:

(a) a first elongated bar having a longitudinal axis in the direction of the longitudinal axis of said chassis member and having one end pivotably attached to said chassis member at a point spaced a distance from said second die member and a lesser distance from said second pivot site;

(b) a second elongated bar having a longitudinal axis parallel to the longitudinal axis of said first bar and having one end pivotably attached to said first toggle arm member at a point between said first and third pivot sites;

(c) said first and second bars each having a longitudinal surface, at least a portion of said longitudinal surface of said first bar being in contact with at least a portion of said longitudinal surface of said second bar for sliding movement of said bars relative to each other in the direction of their longitudinal axes, one of said longitudinal surfaces including an elongated recess in the longitudinal direction, said recess being of uniform depth except for a generally V-shaped transverse wedge protruding toward the other longitudinal surface at the longitudinal center of said recess, the other said longitudinal surface including a series of adjacent transverse scallop-like depressions, each of said depressions except those at each end of said series being of generally arcuate contour, each pair of adjacent depressions of said series meeting at a peak, all said arcuate depressions being of substantially equal depth, the depression at each end of said series being wider in the longitudinal direction and deeper than said arcuate intermediate depressions;

(d) means located respectively on said chassis, said first and second bars, and said first toggle arm and operatively connected for limiting sliding movement of said first and second bars relative to each other so that said elongated recess is always opposite at least a portion of said series of depressions;

(e) a rolling member having circular transverse cross section of predetermined diameter $D_3$ and radius $R_3$ positioned within said elongated recess and in contact with a point on the surface of said series of depressions;

(f) spring biasing means within said elongated recess tending to maintain said rolling member in contact with a surface of said V-shaped wedge; and (g) means located on said second bar for maintaining said portions of said longitudinal surfaces in sliding contact and retaining said rolling member and spring biasing means within said elongated recess, wherein the distance from the deepest point of each said arcuate intermediate depression to the tip of said V-shaped portion of said recess is less than $D_3$ when said V-shaped portion is opposite said arcuate depression, the distance from said peak between any two of said depressions to the deepest surface of said recess is greater than $D_3$ when said peak is opposite said deepest surface, and the distance from the deepest surface of each said depression at each end of said series to the tip of said V-shaped portion of said recess is greater than $D_3$ when said V-shaped portion is opposite said end depression.

11. A tool as claimed in claim 10 in which (a) the depth of each said arcuate depression is about $0.1D_3$; and (b) the curved surface of each said arcuate depression has a radius of curvature equal to from $R_3$ to about $1.1\ R_3$ and subtends a predetermined angle of A degrees.

12. A tool as claimed in claim 11 in which the included angle between the sides of said V-shaped transverse wedge is at least $[180-2\ (A/2+\text{Arc Tan } C)]$ degrees, where C is the coefficient of sliding friction between the surface of said wedge and the surface of said rolling member.

* * * * *